US005465738A

United States Patent [19]

Rowland

[11] Patent Number: 5,465,738

[45] Date of Patent: Nov. 14, 1995

[54] SMOKING SYSTEM

[75] Inventor: Richard K. Rowland, Franklin, Tenn.

[73] Assignee: Music City Marketing, Inc., Nashville, Tenn.

[21] Appl. No.: 364,029

[22] Filed: Dec. 23, 1994

Related U.S. Application Data

[63] Continuation of Ser. No. 865,836, Apr. 9, 1992, abandoned.

[51] Int. Cl.[6] ..... A24F 23/04

[52] U.S. Cl. ..... 131/329; 131/180; 206/242; 206/244; 206/256

[58] Field of Search ..... 131/329, 180, 131/184.1, 231, 232, 240.1, 242, 70, 177, 178, 257, 260; 206/37, 86, 102, 223, 242, 244, 246, 251, 256, 276, 496, 541; 220/500, 503, 505, DIG. 10

[56] References Cited

U.S. PATENT DOCUMENTS

| | | | |
|---|---|---|---|
| 34,308 | 2/1862 | Leslie | 206/244 X |
| 271,011 | 1/1883 | Wilson | 206/102 |
| 498,695 | 5/1893 | Powell . | |
| 842,065 | 1/1907 | Behrman | 206/256 X |
| 1,039,892 | 10/1912 | Buckow . | |
| 1,297,831 | 3/1919 | Gilbert | 206/246 X |
| 3,112,756 | 12/1963 | Schmutte | 131/260 |
| 3,451,533 | 6/1969 | Butler | 206/256 X |
| 4,214,658 | 7/1980 | Crow . | |
| 4,294,267 | 10/1981 | Glymph | 131/180 X |
| 4,612,943 | 9/1986 | Meinkowsky | 131/329 |
| 4,850,481 | 7/1989 | Chern | 206/242 X |

FOREIGN PATENT DOCUMENTS

| | | | |
|---|---|---|---|
| 627736 | 6/1927 | France | 131/231 |
| 340656 | 10/1959 | Switzerland . | |
| 390732 | 4/1933 | United Kingdom . | |
| 418872 | 11/1934 | United Kingdom | 206/86 |

OTHER PUBLICATIONS

River City Manufacturing Brochure "The System", about 1984.
Photographs of Think Wood Products, about 1989.
K.L. Manufacturing Brochure, about 1989.
C and C Enterprises Brochure "New Stuff", about 1991.
J & L (aka Wooden Novelties) Photographs of Products, about 1993.
"Pipes" Brochure by Primitive Creations, about 1989.
Page from Chills Catalog, 1994.
Photographs on Swan Design Products, about 1994.
Photographs of Tip Top Products, about 1994.

*Primary Examiner*—Jennifer Bahr
*Attorney, Agent, or Firm*—Laff, Whitesel, Conte & Saret, Ltd.

[57] ABSTRACT

A smoking system for holding a smoking device, tobacco, filters and a cleaning rod, all in a convenient compact container. The smoking system includes a receptacle having bored within it a number of cavities to hold the smoking device, tobacco, filters and cleaning rod. The cavities containing the smoking device and tobacco are accessible from the top of the receptacle and may be opened or closed by an upper cover. The cavities containing the filters and cleaning rod are accessible from the bottom of the receptacle and may be opened or closed by a lower cover.

21 Claims, 1 Drawing Sheet

SMOKING SYSTEM

This application is a continuation of application Ser. No. 07/865,836 filed Apr. 9, 1992, now abandoned.

FIELD OF THE INVENTION

This invention relates to a smoking system. More particularly, this invention relates to a self-contained smoking system which holds a smoking device, tobacco, filters and a cleaning rod combined in a convenient, compact container.

BACKGROUND OF THE INVENTION

Over the years, different methods of smoking have been developed, including cigarettes, cigars and pipes. Each of these methods, however, has inherent disadvantages.

A cigarette or cigar is convenient to carry and smoke, but only a limited number of tobacco flavors are available on the market in the form of cigarettes or cigars. Many more types of tobacco are available in unrolled form, but to enjoy these, the smoker must smoke the tobacco with a pipe or manually roll a cigarette or cigar.

Moreover, many smokers desire to reduce their smoking habits. Frequently, they take only a few puffs from a cigarette and then discard the remainder. By wasting most of their cigarettes this way, these smokers often wind-up doubling or even tripling their smoking costs simply to reduce their tobacco intake.

Another problem with cigarettes is that the burning end of a lit cigarette contains greater concentrations of harmful chemicals, such as cadmium and carbon monoxide. These chemicals are inhaled by the smoker through the cigarette along with cigarette smoke and then exhaled into the atmosphere.

Of course, smokers can use a pipe to solve some of these problems. With a pipe, a smoker may choose from many more types of tobacco and can regulate the amount smoked. However, different problems can arise. When tobacco is burned, harmful carcinogens are produced, only to be inhaled if not filtered. Many pipes are designed without filters and, consequently, pipe smokers inhale substantial amounts of these carcinogens.

Many people find smoking a pipe burdensome. First, the pipe smoker must carry a pipe and a tobacco pouch, which can be large and cumbersome. Second, filling a pipe with appropriate amounts of tobacco can be difficult, especially in dark or poorly illuminated areas. Third, when packing a pipe, fingers can become soiled. Fourth, pre-packing pipe bowls frequently results in spilled and wasted tobacco, and unless a packed pipe is properly stored after smoking, there is a genuine risk that much of the tobacco in the bowl will also be spilled. Finally, cleaning a pipe is a fairly involved process that can be time-consuming.

With all of the above-mentioned smoking systems, second-hand smoke poses a legitimate health problem. Studies have shown that second-hand smoke can harm the health of non-smokers who spend time near smokers. Yet another danger with the above-mentioned smoking systems is the risk of fire. None of these systems are self-extinguishing, and the careless disposal of a burning cigarette, cigar or pipe can cause an accidental fire.

Devices have been developed in an attempt to ameliorate the problems and disadvantages of smoking cigarettes, cigars and pipes. U.S. Pat. No. 4,214,658 discloses a smoking system in a single unit which allows the user to smoke different types of tobacco, limits the amount of tobacco smoked and provides an easy method of filling the smoking device with tobacco. However, the prior system did not make available a filter system, and there was no provision or method for cleaning the smoking apparatus. Moreover, there were no areas for storing filters or a cleaning device in the unit itself.

Accordingly, an object of the present invention is to provide an improved smoking system that allows either a choice of filtered or non-filtered smoking and combines all smoking and cleaning materials in one unit.

Another object of the present invention is to provide an improved smoking system which utilizes a receptacle for holding a filtered smoking device, tobacco, a cleaning instrument and replaceable filters.

Another object of the present invention is to provide an improved smoking system that reduces the intake of carcinogens.

Another object of the present invention is to provide an improved smoking system which allows the user to regulate the amount of tobacco, thereby helping the smoker to reduce consumption.

Another object of the present invention is to provide an improved smoking system which reduces the amount of second-hand smoke that can affect the health and comfort of nearby nonsmokers.

Yet another object of the present invention is to provide an improved smoking system that is self-extinguishing.

Additional objects, attributes, and advantages of the invention are explained and illustrated in the following description and drawings.

SUMMARY OF THE INVENTION

The present invention renders smoking easier and potentially safer by providing a system which holds a smoking device, tobacco, a supply of filters and a cleaning rod, all inside one convenient and compact container. The smoking system comprises a receptacle bored with several specially configured cavities and sliding covers that open and close the cavities. Included within the receptacle are a smoking device, cavities for filter elements, tobacco, and a cleaning rod.

The system is designed to provide the user with a smoking device that features removable and replaceable filter elements. The bowl of the smoking device, which is stored in one of the cavities, can quickly and easily be filled with tobacco held in an adjacent cavity. The device can then be smoked by the user. It is contemplated that the filter elements as well as the cleaning rod will be stored within at least one of the remaining cavities.

The preceding description as well as other objects, attributes, and advantages of the invention will become apparent in the following detailed description where references are made to the accompanying drawings.

DETAILED DESCRIPTION OF THE INVENTION

Figure 1:
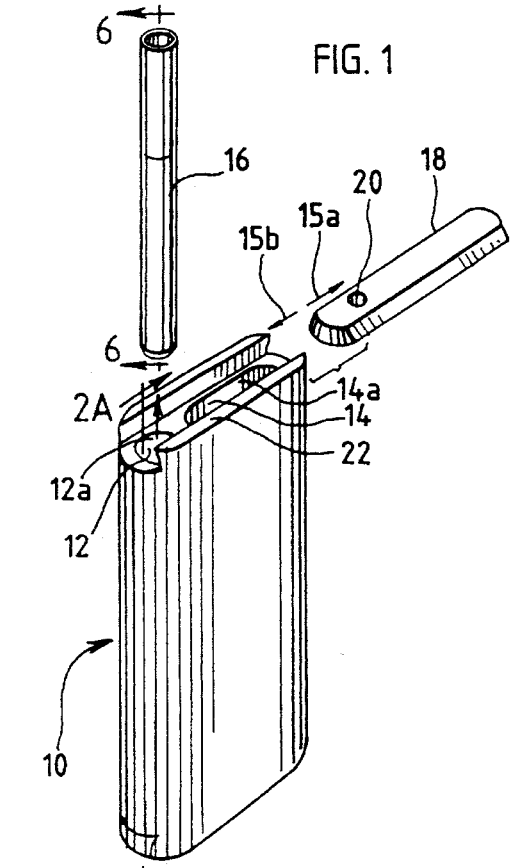
FIG. 1 is an exploded perspective view of the preferred embodiment of the invention when viewed from the top of the system.
Figure 5:
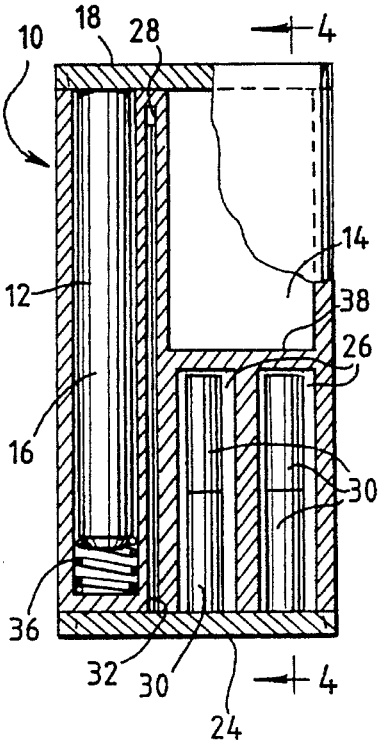
FIG. 5 is a cross section of the preferred embodiment of the invention, taken along line 5—5 of FIG. 2A.
Figure 3:
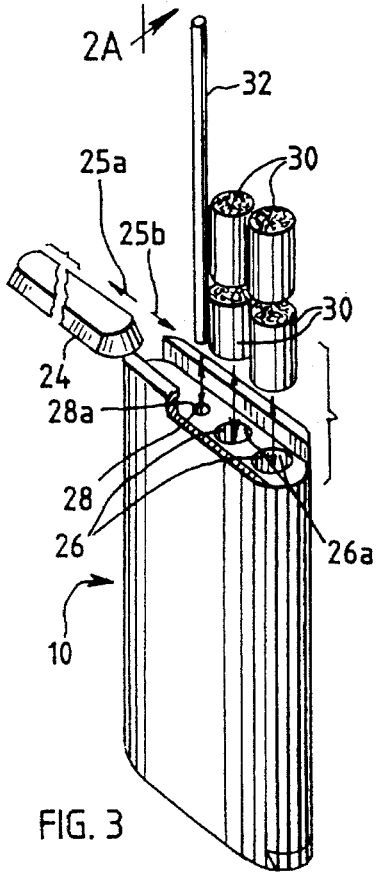
FIG. 3 is an exploded perspective view of the preferred embodiment of the invention when viewed from bottom of the system.

As shown in FIGS. 1, 3 and 5, an improved smoking system provides means for storing a smoking device, smoking material such as tobacco, filtration material and a cleaning and tamping rod. The device includes a receptacle 10 with a number of cavities 12, 14, 26, 28 therein with upper cavities 12, 14 having openings 12*a*, 14*a* located at the top of receptacle 10, and lower cavities 26, 28 having openings 26*a*, 28*a* located at the bottom of receptacle 10. Further, covers 18, 24 are provided to close the cavity openings. A supply of filters 30, a smoking device 16, and a cleaning rod 32 can all be stored within receptacle 10. The cleaning rod 32 is used for changing the filters 30, cleaning the smoking device 16, and for tamping down tobacco (not shown) when it is inside the smoking device 16.

Figure 4:
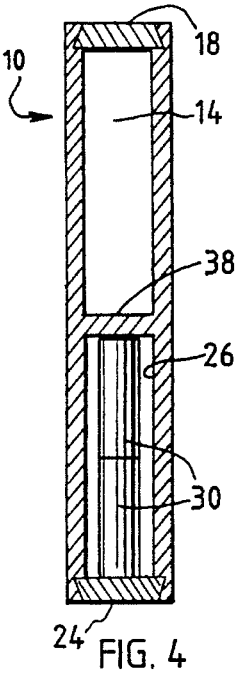
FIG. 4 is a cross section of the preferred embodiment of the invention, taken along line 4—4 of FIG. 5.

Cavities 12, 14, 26, 28 of receptacle 10 are designed to house the various elements of the invention. As shown in FIGS. 1 and 5, upper cavity 12 is preferably cylindrical or otherwise shaped to correspond in shape to smoking device 16 and to hold it in an upright manner. Upper cavity 14 is designed to hold a variety of tobaccos and incorporates rigid base 38 that provides a surface for tamping tobacco when filling smoking device 16. On the bottom of receptacle 10, lower cavities 26 are preferably cylindrical or otherwise sized and shaped to hold a supply of filter elements 30, while lower cavity 28 is also preferably cylindrical and designed to hold cleaning rod 32 (FIGS. 3, 4 and 5). All of the cavities are designed so that the materials to be contained therein do not have room to slide or move substantially within the cavities; and other than the tobacco, they are maintained in their preferred orientation transverse to the covers.

Upper cover 18 is mounted between upper parallel guides 22 on the top of receptacle 10 so that it will slide and release, to expose or close the underlying openings 12*a*, 14*a* in upper cavities 12, 14. Similarly, lower cover 24 is mounted between lower parallel guides 34 on the bottom of the receptacle 10 so that it will slide and release. It is designed to expose and close openings 26*a*, 28*a* in lower cavities 26, 28. When upper and lower covers 18, 24 are in place, as seen in FIG. 5, smoking device 16, tobacco (not shown), filters 30 and cleaning rod 32 are prevented from falling out of receptacle 10, thus providing a convenient single unit for carrying the elements of this smoking system. Upper cover 18 is also designed to include finger recess 20, near an end of cover 18 (FIG. 1), as an aid in moving the upper cover within the upper guides 22, and to distinguish it visually and tactilely from lower cover 24.

Figure 2A:
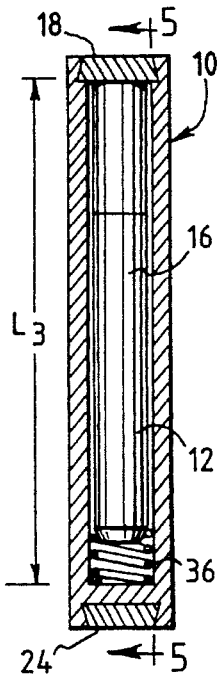
FIG. 2A is a cross section of the preferred embodiment of the invention, taken along line 2A—2A of FIG. 1, depicting the smoking device fully enclosed within the invention and the resilient element in its compressed state.
Figure 2B:
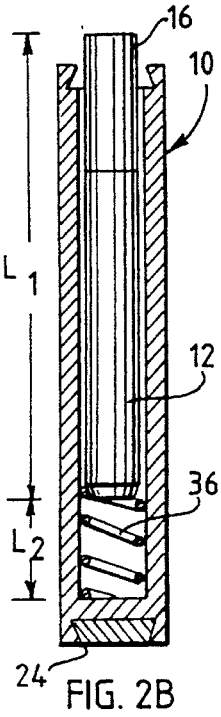
FIG. 2B is a cross section of the preferred embodiment of the invention, also taken along line 2A—2A of FIG. 1, depicting the smoking device extended and the resilient element in its relaxed state.

At the bottom of cavity 12 is a resilient element 36, such as a spring or spongy material. As seen in FIGS. 2A and 2B, the length $L_1$ of smoking device 16 plus length $L_2$ of resilient element 36 in its relaxed state is greater than the length $L_3$ of cavity 12. Thus, when the smoking device 16 is stored in cavity 12 (FIG. 2A), it compresses resilient element 36. When the cover 18 is removed (FIG. 2B), this compression is released, and the smoking device 16 is pushed upwardly as described below.

Figure 6:
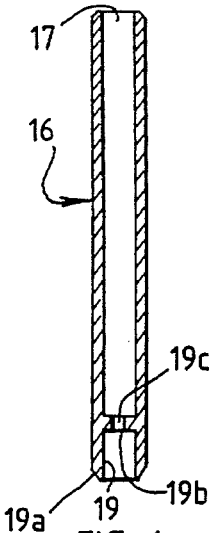
FIG. 6 is a cross section of the smoking device component of the invention, taken along line 6—6 of FIG. 1.

As shown in FIG. 6, smoking device 16 includes a filter cavity 17 and a tobacco bowl 19. Filter cavity 17 comprises a hollowed, preferably cylindrical cavity which is designed to receive filter element 30. Tobacco bowl 19 comprises a hollowed cavity preferably having a beveled edge 19*a* and a base 19*b*. The base 19*b* is perforated by hole 19*c*, through which the user draws the tobacco smoke. The filter elements 30, which are inserted into filter cavity 17, are usually cylindrically shaped and are manufactured from a soft, densely-packed fibrous material. The filter elements are disposable and replaceable, and may be stored inside receptacle 10.

Bowl 19 of smoking device 16 is also designed to be self-extinguishing. Tobacco bowl 19 is long and narrow, and because of its shape and length, sufficient oxygen is unable to reach all of the burning tobacco packed within bowl 19 and thereby maintain combustion unless the user draws the oxygen through the smoking device 16. Therefore, if the smoking device is left unattended, oxygen will not reach all of the tobacco, and the fire will extinguish. This improvement greatly increases the safety of the device when compared with prior systems as well as conventional cigarettes, cigars and pipes. It also reduces the temptation to continue smoking. Additionally, because of the longer bowl, the user has the option to smoke more tobacco at a single instance.

The operation of the invention is as follows. As shown in FIG. 1, upper cover 18 is moved to one side of receptacle 10 by placing a finger in recess 20 and sliding upper cover 18 through parallel guides 22 in the direction of arrow 15*a*. Once upper cavity 12 is uncovered, smoking device 16 springs upward slightly due to the release of compression force provided by resilient element 36. Smoking device 16 is then removed from receptacle 10, and upper cover 18 is moved back in the direction of arrow 15*b*, thereby covering upper cavity 12 and uncovering upper cavity 14 and the tobacco (not shown) contained therein.

To load tobacco (not shown) into bowl 19 of smoking device 16, smoking device 16 is inserted, bowl 19 end first, into upper cavity 14 which contains tobacco. With a slight twisting action, smoking device 16 and bowl 19 are moved up and down within upper cavity 14 until bowl 19 is filled with tobacco. Smoking device 16 is then tamped against rigid base 38, to help pack the tobacco within bowl 19, while beveled edges 19*a* of bowl 19 cut away any excess tobacco. With bowl 19 now filled with tobacco, upper cover 18 is replaced to its original position through parallel guides 22 covering upper cavities 12, 14.

To load a filter element 30 into filter cavity 17 of smoking device 16, receptacle 10 is inverted to expose lower cover 24. As shown in FIG. 3, lower cover 24 may now be moved in a manner similar to that described above when moving upper cover 18 by sliding lower cover 24 through parallel guides 34 in direction of arrow 25*a* exposing lower cavities 26. By inverting receptacle 10, gravity causes a filter element 30 to fall from lower cavities 26 of receptacle 10. Receptacle 10 is once again inverted and lower cover 24 is moved through parallel guides 34 in the direction of arrow 25*b* to its original position covering lower cavities 26, 28. With a slight pushing and twisting action, filter element 30 is then placed in filter cavity 17 of smoking device 16.

Smoking device 16 may now be lighted and smoked. When the smoking urge has been satisfied, smoking device 16, with bowl 19 still filled with tobacco, may be returned to upper cavity 12 by moving upper cover 18 in a fashion as previously described and shown in FIG. 1.

When smoking is to be once again resumed, smoking device 16 is removed from upper cavity 12 in a manner previously described by moving upper cover 18 as shown in FIG. 1. This process may continue until tobacco in bowl 19 is fully consumed.

When tobacco in bowl 19 is fully consumed, bowl 19 may be cleaned by inserting cleaning rod 32 into bowl 19 and reaming along inside perimeter of bowl 19 while pulling out spent tobacco, ash, and embers with cleaning rod 32.

Cleaning rod 32 is extracted from receptacle 10 by inverting receptacle 10 and moving lower cover 24 in a fashion previously described and shown in FIG. 3 to uncover lower cavity 28 and remove cleaning rod 32. When finished cleaning bowl 19, cleaning rod 32 may be pushed through bowl 19 and through hollowed filter cavity 17 to expel used filter element 30 out of the end of filter cavity 17. Cleaning rod 32 may now be returned to lower cavity 28 and lower cover 24 moved through parallel guides 34 to cover lower cavities 26, 28.

Because of filter elements 30, many of the harmful carcinogens will not reach the smoker's lungs. Also, the size and shape of the bowl allows only small amounts of smoke to be released into the air when the smoking device is used. This greatly reduces the amount of secondhand smoke. Also, if the smoker desires a greater smoking pleasure, cleaning rod 32 may be used to tamp or pack down additional smoking material tightly into bowl 19, providing the user with a longer, slower burning smoke. On the other hand, a smoker trying to stop smoking may prepare the smoking device with only a small amount of tobacco, just enough to satisfy the smoking urge.

While the principles of the invention have been described above in connection with specific embodiments, these descriptions are intended only by way of example and not as a limitation on the scope of the invention, which is stated more broadly in the appended claims. Therefore, the claims are to be construed as covering all equivalents.

The invention claimed is:

1. A smoking system comprising:

a receptacle having a top, a bottom, and at least three cavities; said top accessing at least one of said cavities, and said bottom accessing at least one other of said cavities, at least one of said cavities adapted for storing smoking filters; each of said cavities being accessible exclusively from said bottom or said top, but not both;

smoking device means removably disposed in another of said cavities, said smoking device means being suitable for use with smoking filters; and means for cleaning said smoking device means, said cleaning means removably disposed in yet another of said cavities.

2. The smoking system as in claim 1, wherein said cavities include a first and a second cavity accessible from said top of said receptacle, said first cavity for storing said smoking device means and said second cavity for storing smoking material, said second cavity being shallower and wider than said first cavity.

3. The smoking system as in claim 2, wherein said smoking device means is shorter in length than said first cavity and greater in length than said second cavity.

4. The smoking device means as in claim 3, wherein said bowl portion further includes an external beveled edge and a perforated base bordering said filter cavity, said beveled edge for cutting smoking material, and said perforated base for allowing smoke to pass out of said bowl portion.

5. The smoking device as in claim 4, wherein said bowl portion has a sufficiently long and narrow interior cavity in order to prevent sufficient oxygen from reaching smoking material contained therein unless the user draws oxygen through the bowl portion.

6. The smoking system as in claim 1, wherein said cavity for storing smoking filters is accessible from said bottom of said receptacle.

7. The smoking system as in claim 1, wherein said cavity in which said cleaning means are removably disposed is accessible from said bottom of said receptacle.

8. The smoking system as in claim 1, and an upper cover engaging said top of said receptacle for opening and closing any of said cavities which are accessible from said top, and a lower cover engaging said bottom of said receptacle for opening and closing any of said cavities which are accessible from said bottom.

9. The smoking system as in claim 1, wherein at least one of said cavities is adapted for storing a plurality of filters.

10. The smoking system as in claim 1, wherein said cleaning means is a rod.

11. A smoking system comprising:

a receptacle having a top end and a bottom end, a first cavity, a second cavity, a third cavity and a fourth cavity therein, said second cavity having a rigid base, said third cavity for storing smoking filters, said second and third cavities being shallower than said first and fourth cavities, respectively, said fourth cavity being narrower than said first cavity;

openings in said receptacle leading to each of said cavities; the openings of said first and second cavities being on one end of the receptacle and the openings of said third and fourth cavities being on the opposite end of the receptacle; each of said cavities having only one of said openings;

smoking device means removably disposed in said first cavity and having a bowl portion in one end thereof, the length of said smoking device means being greater than the depth of said second cavity;

said second cavity adapted for storing smoking material and having a surface on said rigid base for tamping smoking material when filling said smoking device means;

cleaning means removably disposed in said fourth cavity, said cleaning means having a diameter smaller than the interior of said bowl portion and said cleaning means having a length less than the depth of said fourth cavity;

first cover means associated with said receptacle across said openings of said first and second cavities, and second cover means associated with said receptacle across said openings of said third and fourth cavities, said first cover means movable alternately to close or expose said first or second cavities, and said second cover means movable alternately to close or expose said third or fourth cavities.

12. A smoking system comprising:

a receptacle having a top, a bottom, and at least three cavities; said top providing access to at least one of said cavities and said bottom providing access to at least one other of said cavities, each of said cavities being accessed exclusively from the top or the bottom, at least one of said cavities adapted for storing smoking filters;

and smoking device means removably disposed in another of said cavities, said smoking device means suitable for use with smoking filters;

wherein a first and second cavity are accessible from said top of said receptacle, said first cavity adapted for storing said smoking device means and said second cavity adapted for storing smoking material, said second cavity being shallower and wider than said first cavity.

13. The smoking system as in claim 12, wherein said smoking device means comprises a hollow cylinder shorter in length than said first cavity and greater in length than said second cavity, said smoking device means also having a bowl portion disposed on one end thereof and a filter cavity disposed on the other end thereof.

14. The smoking device as in claim 13, wherein said bowl portion further includes an external beveled edge and a perforated base bordering said filter cavity, said beveled edge for cutting smoking material, and said perforated base for allowing smoke to pass out of said bowl portion.

15. The smoking device as in claim 14, wherein said bowl portion has a sufficiently long and narrow interior cavity in order to prevent sufficient oxygen from reaching smoking material contained therein unless the user draws oxygen through the bowl portion.

16. A smoking system comprising:

a receptacle having a top end, a bottom end and at least three cavities;

openings in said receptacle leading to each of said cavities, the opening of at least one of said cavities being on said top end of the receptacle and the opening of at least another one of said cavities being on said bottom end of the receptacle; each of said cavities being accessed by only one of said openings;

first cover means associated with said top end of the receptacle and across at least one of said openings; and second cover means associated with said bottom end of the receptacle and across at least another one of said openings, said first cover means movable alternately to close or expose at least one of said openings, and said second cover means movable alternately to close or expose at least another one of said openings.

17. The smoking system as in claim 16, wherein the system has at least four cavities;

a first cavity is adapted for removably storing smoking device means;

a second cavity is adapted for storing smoking material and having a rigid base for tamping smoking material when filling said smoking device means;

a third cavity is adapted for storing smoking filters; and a fourth cavity is adapted for storing means for cleaning said smoking device.

18. The smoking system as in claim 17, including a resilient element disposed at the bottom of said first cavity, said resilient element being in a compressed state when said first cover means is closed over the opening of said first cavity and said smoking device means is in said first cavity, and in a relaxed state when said first cover means is open, and said relaxed state being sufficient to allow an end of said smoking device means to emerge from said first cavity.

19. The smoking system as in claim 16 wherein the first and second cover means are pivotally mounted on said receptacle.

20. The smoking system as in claim 16 wherein the first and second cover means are individually slidably associated with the receptacle.

21. The smoking system as in claim 16 wherein:

a first cavity is adapted for storing smoking device means;

a second cavity is adapted for storing smoking material; and a third cavity is adapted for storing smoking filters.

* * * * *